United States Patent [19]

Enoguchi et al.

[11] Patent Number: 5,052,335

[45] Date of Patent: Oct. 1, 1991

[54] ELECTROSTATIC LATENT IMAGE DEVELOPING DEVICE

[75] Inventors: Yuji Enoguchi; Toshiya Natsuhara; Hiroshi Mizuno, all of Osaka, Japan

[73] Assignee: Minolta Camera Kabushiki Kaisha, Osaka, Japan

[21] Appl. No.: 328,225

[22] Filed: Mar. 24, 1989

[30] Foreign Application Priority Data

Mar. 25, 1988 [JP] Japan ..... 63-72961

[51] Int. Cl.[5] ..... G03G 15/09

[52] U.S. Cl. ..... 118/658; 355/245; 355/251; 355/253

[58] Field of Search ..... 355/245, 259, 253, 251; 118/658, 653

[56] References Cited

U.S. PATENT DOCUMENTS 4,100,884 7/1978 Mochizuki et al. ..... 118/653
4,282,827 8/1981 Andrews ..... 118/648
4,615,608 10/1986 Mizutani ..... 118/658 X
4,791,882 12/1989 Enoguchi et al. ..... 355/259 X
4,883,017 11/1989 Yuji et al. ..... 355/259 X
4,907,032 3/1990 Enoguchi et al. ..... 355/253

*Primary Examiner*—A. T. Grimley
*Assistant Examiner*—J. E. Barlow, Jr.
*Attorney, Agent, or Firm*—Burns, Doane, Swecker & Mathis

[57] ABSTRACT

A developing device confronting a rotatably provided electrostatic latent image support member and including a rotatable developing roller confronting said electrostatic latent image support member, a flexible outer sleeve having a peripheral length larger than that of the developing roller so as to be loosely fitted around the developing roller, an urging member for depressing the outer sleeve against the developing roller so as to form a gap between the developing roller and the outer sleeve such that a peripheral surface of the outer sleeve is brought into contact, at a downstream side or an upstream side of its location having a maximum distance from an axis of the developing roller in a rotational direction of the outer sleeve, with the electrostatic latent image support member when the developing roller is rotated and a member for forming a toner layer on the peripheral surface of said outer sleeve.

18 Claims, 5 Drawing Sheets

ELECTROSTATIC LATENT IMAGE DEVELOPING DEVICE

BACKGROUND OF THE INVENTION

The present invention generally relates to an electrophotographic apparatus, an electrostatic recording apparatus or the like and more particularly, to a developing device which supplies toner to an electrostatic latent image formed on an electrostatic latent image support member so as to develop the electrostatic latent image into a visible image.

A developing device employing one-component developer has been already proposed in, for example, Japanese Patent Laid-Open Publication No. 143831/1977 in which non-magnetic toner is supplied to a surface of an elastic roller and a blade is pressed against the surface of the elastic roller so as to form an electrically charged toner layer on a outer peripheral surface of the elastic roller such that a toner image is formed by bringing the electrically charged toner layer into direct contact with a surface of the electrostatic latent image support member.

In the prior art developing device, the developing roller is required to be brought into contact with the electrostatic latent image support member uniformly in the axial direction of the electrostatic latent image support member. However, the developing roller or the electrostatic latent image support member itself of the prior art developing device have a slight distortion or dimensional errors which are produced during its manufacture. Thus, the prior art developing device include a drawback in that it is quite difficult to bring the developing roller and the electrostatic latent image support member into contact with each other uniformly in the axial direction of the electrostatic latent image support member.

Meanwhile, in the prior art developing device, the blade is required to be brought into contact with the developing roller at a predetermined pressing contact pressure or more so as to form the electrically charged toner layer on the surface of the developing roller. Therefore, hardness required of the elastic roller is relatively high. On the contrary, a portion of the elastic roller, which is brought into contact with the electrostatic latent image support member, should have a very low hardness in order to prevent damage to the electrostatic latent image and disruption of the image. Thus, the developing roller is required to satisfy entirely opposite hardness requirements. Since such developing roller does not exist, either one of the requirements are neglected undesirably.

Meanwhile, another developing device is known from Japanese Patent Laid-Open Publication No. 77764/1980 in which toner is electrically attached, by using a magnetic brush, to the surface of a roller made of foamed, soft and electrically conductive elastic material and having an electrically conductive film on its surface. In the known developing device, the toner is attached to the electrostatic latent image through contact of the roller with the surface of the electrostatic latent image support member.

However, this prior art developing device has the following disadvantage. Namely, although the roller is made of foamed material, pressing contact pressure of the roller against the electrostatic latent image support member is large. Especially where the peripheral speed of the surface of the roller is different from that of the surface of the electrostatic latent image support member, the image formed on the surface of the electrostatic latent image support member is disrupted.

SUMMARY OF THE INVENTION

Accordingly, an essential object of the present invention is to provide an electrostatic latent image developing device which includes an endless toner support member loosely fitted around an outer periphery of a drive roller having a diameter slightly smaller than that of the toner support member and in which, when a slack portion of the toner support member, formed due to difference in diameter between the toner support member and the drive roller, is brought into contact with an electrostatic latent image support member through rotation of the drive roller so as to develop an electrostatic latent image on the electrostatic latent image support member, a point of contact between the toner support member and the electrostatic latent image support member is disposed downstream of or upstream of a location of a maximum slack of the slack portion of the toner support member in a rotational direction of the drive roller.

In the electrostatic latent image support member of the above described arrangement, since the toner support member can be brought into contact with the electrostatic latent image support member uniformly and stably in the axial direction of the electrostatic latent image support member so as to maintain a uniform nip width, a remarkably excellent image free from nonuniform development can be formed.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
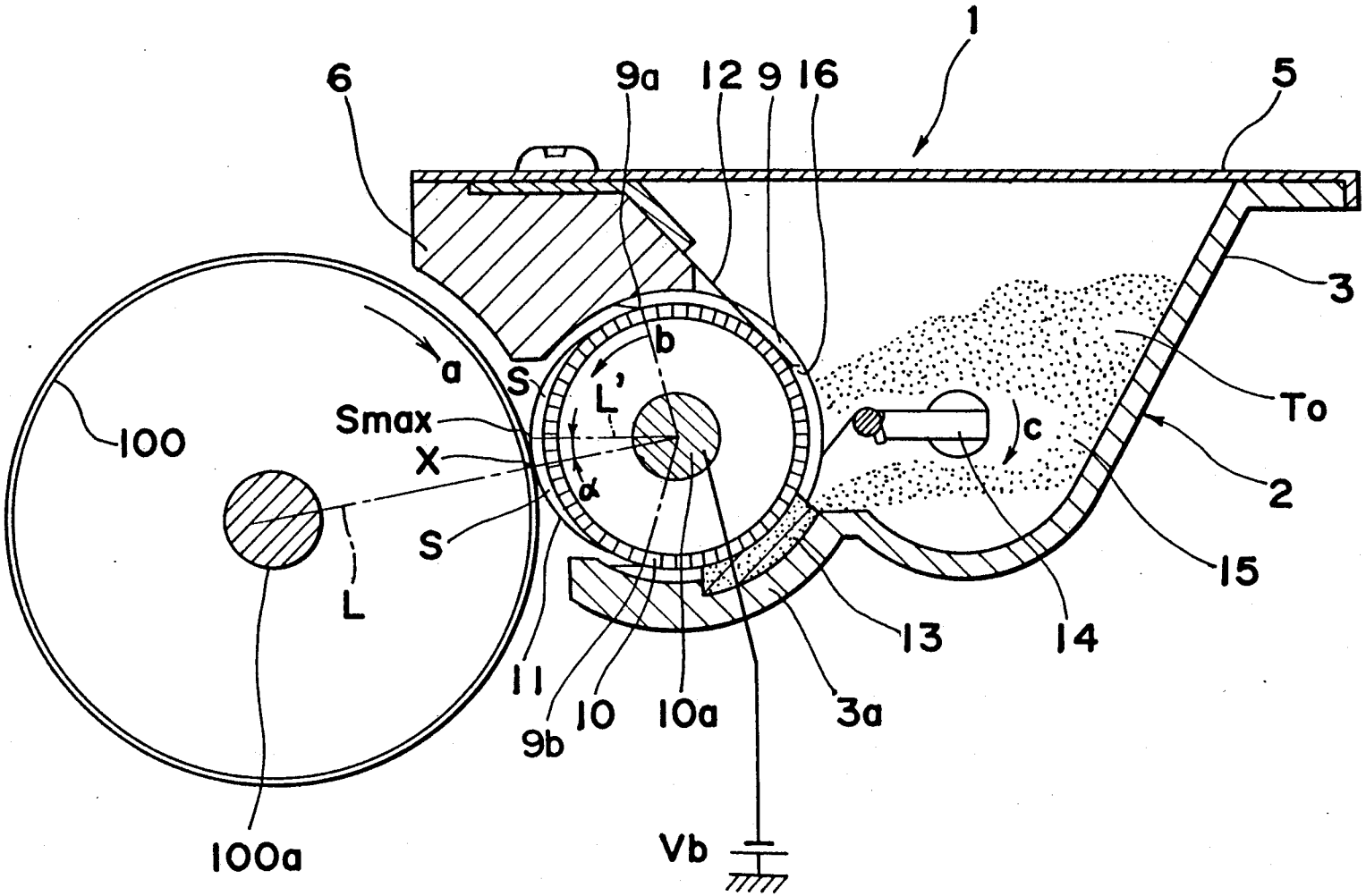
FIG. 1 is a sectional view of an electrostatic latent image developing device according to the present invention.

Referring now to the drawings, there is shown in FIG. 1, a developing device 1 according to the present invention. The developing device 1 is disposed at a side of a photosensitive drum 100 acting as an electrostatic latent image support member driven for rotation in the direction of the arrow a. The developing device 1 includes a casing 2, a drive roller 10 and a filmy member 11 acting as a toner support member. The casing 2 is constituted by a frame 3 for covering a bottom portion and a rear portion of the casing 2, a pair of opposite side walls 4 (FIG. 2), a cover 5 and a support member 6 attached to a front portion of the cover 5.

The drive roller 10 is obtained by forming electrically conductive material such as aluminum, stainless steel, etc. into a cylindrical shape or by winding electrically conductive elastic material such as nitrile rubber, silicone rubber, styrene rubber, butadiene rubber, etc. around an outer periphery of a metallic roller. A developing bias voltage Vb is applied to the drive roller 10.

The filmy member 11 acting as the toner support member is formed into a tubular shape having a peripheral length slightly larger than that of the drive roller 10 so as to be loosely fitted around the drive roller 10. The filmy member 11 is formed by a soft resinous sheet made of, for example, polycarbonate, nylon, fluoroplastic, etc. or a sheet made of the above described resin mixed with carbon, metallic powder, etc. or a metallic thin film made of nickel, stainless steel, aluminum, etc. or a laminate sheet of the above described resinous sheet and the metallic thin film.

Figure 2:
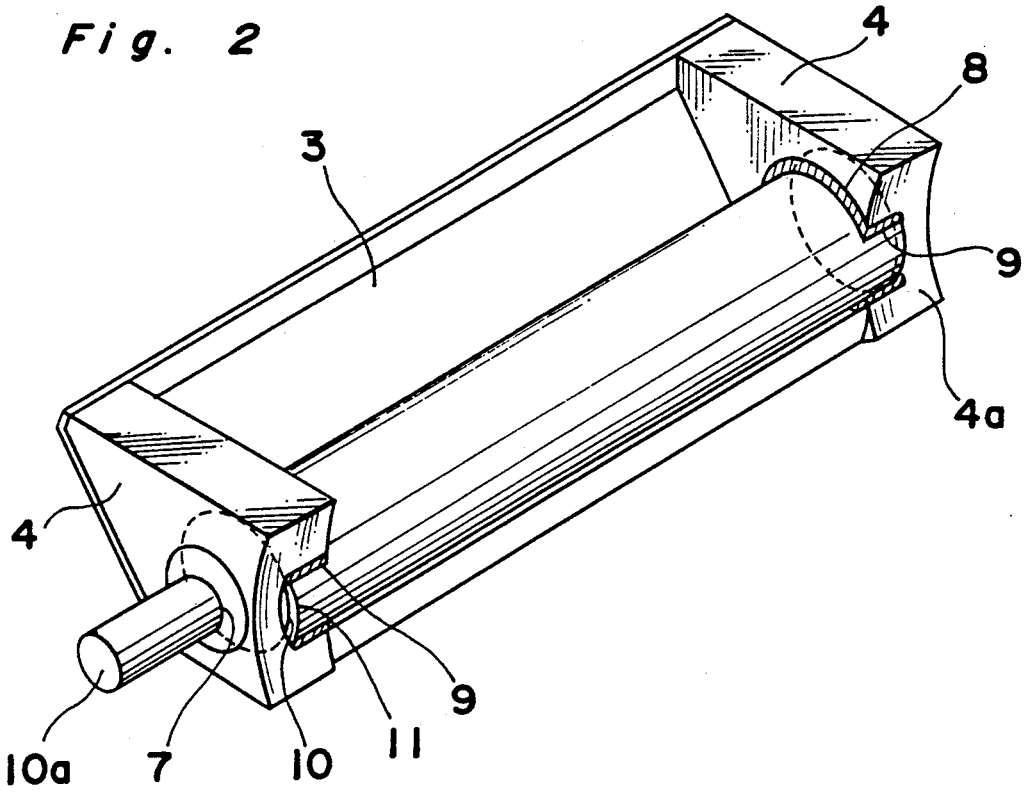
FIG. 2 is a perspective view of a drive roller employed in the developing device of FIG. 1.

As shown in FIG. 2, the drive roller 10 having the filmy member 11 fitted therearound is rotatably supported by a support shaft 10*a* passing through bores 7 formed on the opposite side plates 4, respectively and is coupled with a driving source (not shown) so as to be driven by the driving source. Meanwhile, opposite end portions of the drive roller 10 are, respectively, placed in recessed portions 8 formed on the opposite side plates 4. At each of the recessed portions 8, an elastic pad 9 is interposed between the recessed portion 8 and the filmy member 11 fitted around the drive roller 10 so as to bring the filmy member 11 into close contact with the outer periphery of the drive roller 10. The elastic pad 9 has a guide surface of a shape corresponding to the peripheral surface of the drive roller 10 so as to depress the filmy member 11 against the drive roller 10 at each of opposite end portions of the drive roller 10. The guide surface of the elastic pad 9 has a central angle of 180° to 250° with respect to the axis of the drive roller 10. The elastic pad 9 has opposite end portions 9*a* and 9*b* which defines a opening confronting the photosensitive drum 100. The elastic pad 9 may be made of resin, for example, polyacetal, phenol, polyethylene, nylon, fluoroplastic, etc. Alternatively, the elastic pad 9 may be formed by providing on the above described resin, a film made of polyethylene, nylon, Teflon (name used in trade and manufactured by E.I. du Pont de Nemours & Co., Inc. of the U.S.), etc. such that the film comes into contact with the filmy member 11. Furthermore, the elastic pad 9 may be formed by providing the above mentioned film on a surface of foamed material. The recessed portion 8 opens into a front face 4*a* of each of the side plates 4 at one side of the recessed portion 8 confronting the photosensitive drum 100 and the elastic pad 9 is cut off at this open portion of the recessed portion 8.

Therefore, a portion of the filmy member 11 coming into contact with the elastic pad 9 is brought into close contact with the outer periphery of the drive roller 10. Meanwhile, with respect to the drive roller 10, a surplus portion of the filmy member 11 having the peripheral length slightly larger than that of the drive roller 10 is concentrated at the remaining portion of the filmy member 11, namely at a portion of the filmy member 11 disposed at the front face 4*a* of each of the side plates 4, so that a slack portion S is formed between the filmy member 11 and the drive roller 10 at the portion of the filmy member 11 disposed at the front face 4*a* of each of the side plates 4. The outer periphery of the slack portion S of the filmy member 11 is brought into contact with the peripheral surface of the photosensitive drum 100. The opening of the elastic pad 9 is provided so as to form an angle $\alpha$ between a bisector of an angle defined by lines connecting the opposite end portions 9*a* and 9*b* with the axis of the drive roller 10 and a line connecting the axis of the drive roller 10 and the axis of the photosensitive drum 100 such that a contact portion X is disposed downstream of a location Smax of a maximum slack of the slack portion S of the filmy member 11, i.e. a location of the filmy member 11 lying at a maximum distance from the axis of the drive roller 10, in the rotational direction b of the drive roller 10.

Meanwhile, a coefficient $\mu 1$ of friction between the outer peripheral surface of the drive roller 10 and the inner peripheral surface of the filmy member 11 is so set as to be larger than a coefficient $\mu 2$ of friction between the outer peripheral surface of the filmy member 11 and the elastic pads 9, i.e. $\mu 1 > \mu 2$. Thus, when the drive roller 10 is rotated in the direction of the arrow b of FIG. 1, the filmy member 11 is rotated together with the drive roller 10 without slip relative to the drive roller 10 such that the outer surface of the slack portion S of the filmy member 11 rubs against the surface of the photosensitive drum 100 at a proper nip width.

A blade 12 is attached to a rear face of the support member 6 provided above the drive roller 10 and a flexible sheet made of, for example, Teflon, nylon, etc. is provided at a distal end of the blade 12. At an obliquely upward rear portion of the peripheral surface of the drive roller 10, the blade 12 is pressed against the drive roller 10 through the filmy member 11. The blade 12 may be formed by an elastic metal sheet made of carbon tool steel, stainless steel, phosphor bronze. etc., an elastic plate made of silicone rubber, urethane rubber, a plate made of fluoroplastic, a plate made of nylon or a composite panel of these plates referred to above.

Meanwhile, a pad 13 for uniforming a toner layer on the filmy member 11 is attached to a portion of the frame 3 confronting the drive roller 10. In the pad 13, a sheet made of silicone rubber is provided on a surface of an elastic layer made of, for example, foamed urethane. The pad 13 is brought into contact with the outer peripheral surface of the drive roller 10 through the filmy member 11.

A toner tank 15 for storing toner To is provided at a rear portion of the casing 2. In the toner tank 15, an agitator 14 is rotatably provided so as to be rotated in the direction of the arrow c. The agitator 14 carries in the direction of the arrow c the toner To stored in the toner tank 15 so as to prevent blocking of the toner To.

The operation of the developing device 1 of the above described arrangement will now be described. When the drive roller 10 and the agitator 14 are, respectively, rotated in the directions of the arrows b and c by the driving source (not shown), the toner To stored in the toner tank 15 is forcibly carried in the direction of the arrow c by agitation of the agitator 14. On the other hand, the filmy member 11 is rotated in the direction of the arrow b together with the drive roller 10 due to a frictional force exerted between the filmy member 11 and the drive roller 10. Thus, the toner To coming into contact with the filmy member 11 is subjected, through its contact with the filmy member 11 and by electrostatic force, to a force for transporting the toner To in the direction of the arrow b. Subsequently, the toner To is introduced into a wedgy inlet region 16 formed by the filmy member 11 and the distal end portion of the blade 12. Then, when the toner To has reached a location of pressing contact between the blade 12 and the filmy member 11, the toner To not only is uniformly coated, as a thin layer, on the surface of the filmy member 11 but is triboelectrically charged to a positive or negative polarity of the toner To.

Upon rotation of the filmy member 11 together with the drive roller 10, the toner To held on the filmy member 11 by electrostatic force produced by electrical charging of the toner To is further conveyed to a location confronting the photosensitive drum 100, i.e. the contact portion X. At the contact portion X, the toner To adheres, by an electric field based on potential difference between surface potential of the photoreceptive sheet 100 and the bias voltage applied to the drive roller 10, to the electrostatic latent image formed on the surface of the photosensitive drum 100 so as to form a toner image.

At this time, since the filmy member 11 in contact with the photosensitive drum 100 is held in contact with the drive roller 10 through the slack portion S, the filmy member 11 is softly and uniformly brought into contact with the photosensitive drum 100 at a proper nip width so as to form the electrostatic latent image on the photosensitive drum 100 into a uniform toner image. Meanwhile, when a peripheral speed of the photosensitive drum 100 is made different from that of the filmy member 11, fog in an image nonforming portion can be effectively eliminated and a toner image formed once on the photosensitive drum 100 is not disrupted.

The toner To having passed through the contact portion X acting as a developing region is further conveyed in the direction of the arrow b together with the filmy member 11. Thus, when the toner To reaches the pad 13, the toner To is pressed between the filmy member 11 and the pad 13, so that a toner pattern consumed previously at the contact portion X is erased and thus, the toner layer on the filmy member 11 is uniform.

Subsequently, again at the location of pressing contact between the filmy member 11 and the blade 12, an electrically charged uniform toner layer is formed on the filmy member 11. Then, the above described operation is repeated.

In the developing device 1, the slack portion S of the filmy member 11 is softly brought into contact with the surface of the photosensitive drum 100 through utilization of rigidity of the filmy member 11 such that development is performed by the toner transported by the filmy member 11. In order to perform high-quality development in which an excellent developed image free from nonuniform or faint portions, the filmy member 11 should be brought into sliding contact with the surface of the photosensitive drum 100 at a stable and uniform speed. Furthermore, it was found that when the contact portion X is disposed downstream of the location Smax of the maximum slack of the slack portion S of the filmy member 11 in the rotational direction b of the drive roller 10 in an inoperative state of the developing device 1 as shown in FIG. 1, the contact portion X is still disposed downstream of the location Smax of the maximum slack of the filmy member 11 in the rotational direction b of the drive roller 10 in an operative state of the developing device 1 and development is performed excellently by the developing device 1.

Figure 4A:
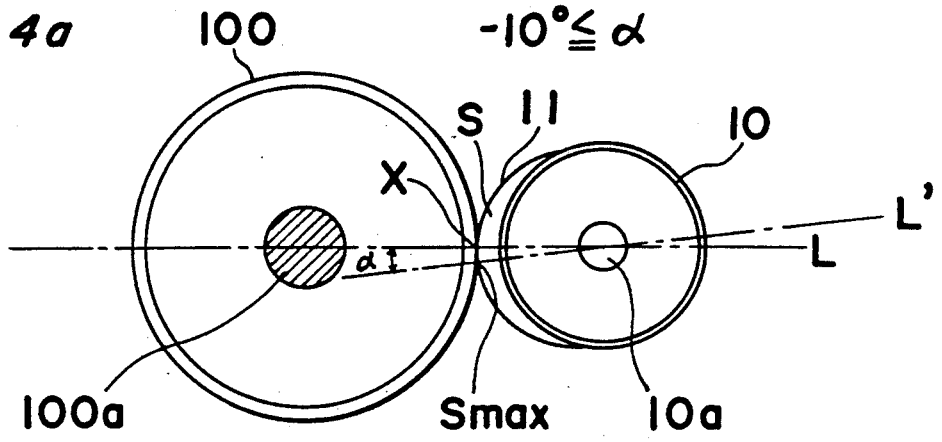
FIGS. 4*a*, 4*b* and 4*c* are views showing positions of a filmy member relative to a photosensitive drum in an inoperative state of the developing device of FIG. 1.
Figure 4B:
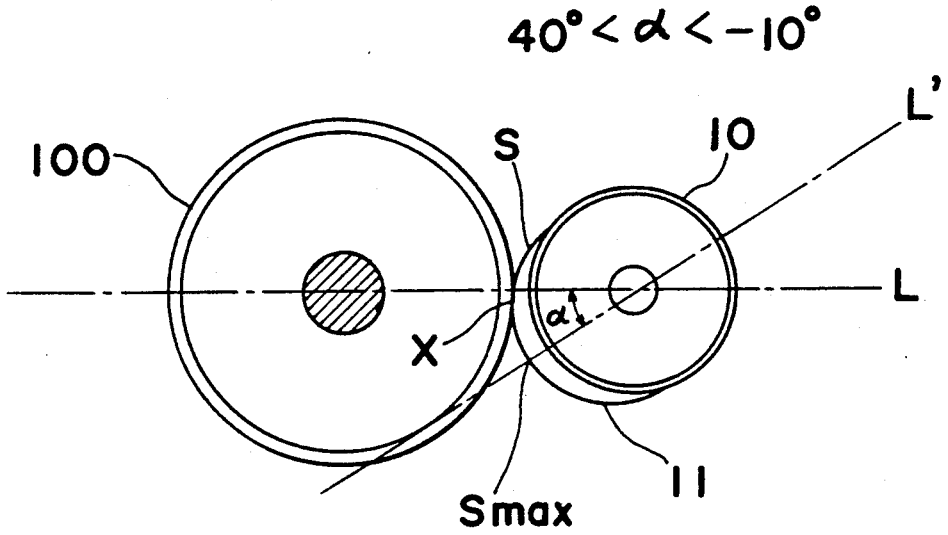
Figure 4C:
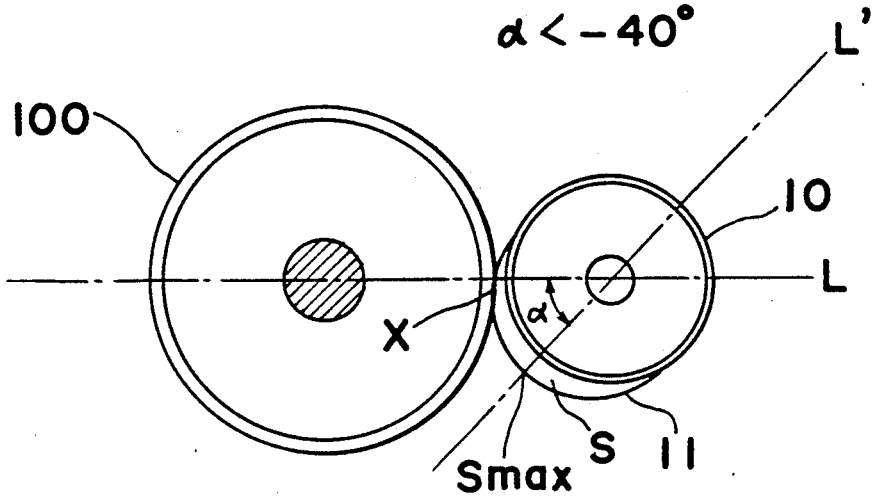
Figure 5A:
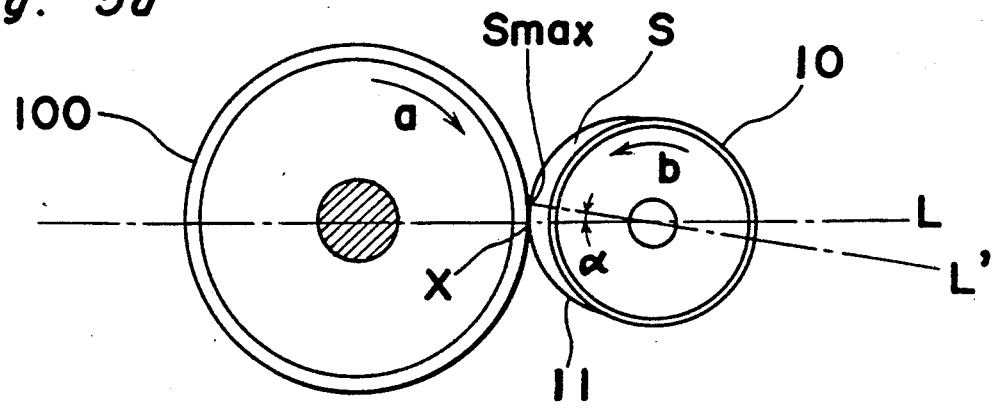
FIGS. 5*a*, 5*b* and 5*c* are views in an operative state of the developing device of FIG. 1, corresponding to FIGS. 4*a*, 4*b* and 4*c*, respectively.
Figure 5B:
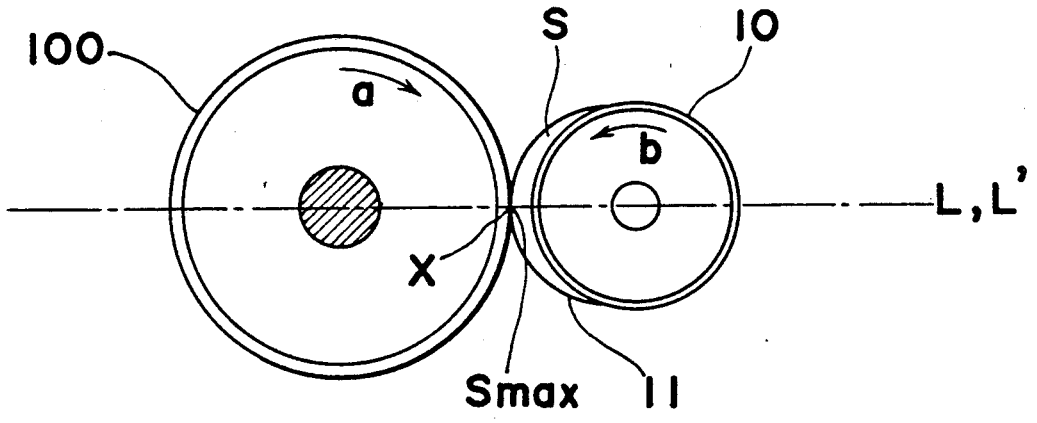
Figure 5C:
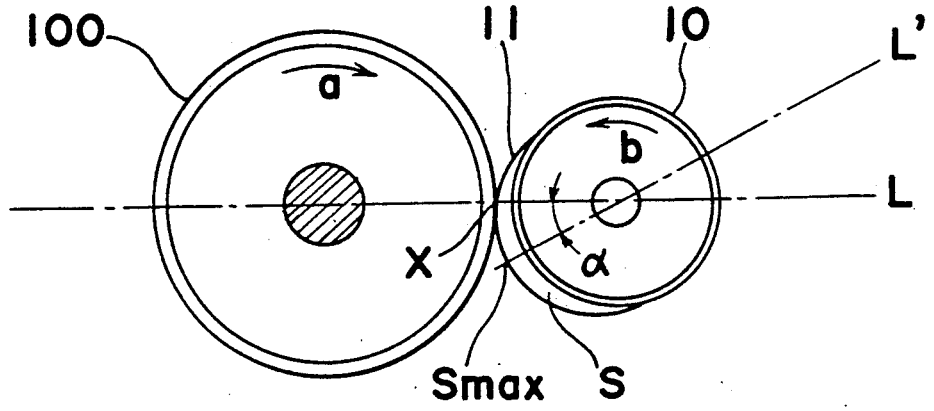

Experimental results are now described in which position of the filmy member 11 relative to the photosensitive drum 100 is changed. FIGS. 4*a* to 4*c* and FIGS. 5*a* to 5*c* show experimental results in which the position of the filmy member 11 relative to the photosensitive drum 100 is changed variously in the inoperative state and the operative state of the developing device 1, respectively. FIGS. 5*a* to 5*c* correspond to FIGS. 4*a* to 4*c*, respectively. Thus, when the filmy member 11 and the photosensitive drum 100 set as shown in FIGS. 4*a* to 4*c* are driven, the filmy member 11 is set relative to the photosensitive drum 100 as shown in FIGS. 5*a* to 5*c*, respectively. In FIGS. 4*a* to 4*c*, the photosensitive drum 100 and the filmy member 11 are driven at the peripheral speeds V1 and V2, respectively by setting the peripheral speed V2 of the filmy member 11 and the peripheral speed V1 of the photosensitive drum 100 to the ratio of 3 to 1, i.e. $V2/V1=3$. In FIGS. 4*a* to 4*c*, the filmy member 11 has a diameter of 25 mm and the drive roller 10 has a diameter of 24 mm. Meanwhile, the elastic pad 9 has a central angle of 180°. In FIGS. 4*a* to 4*c* and FIGS. 5*a* to 5*c*, a centerline L connects a shaft 10*a* of the drive roller 10 and a shaft 100*a* of the photosensitive drum 100. Furthermore, L′ denotes a line connecting the location Smax of the maximum slack and the shaft 10*a* of the drive roller 10 and $\alpha$ denotes an angle formed between the centerline L and the line L′.

In FIG. 4*a*, the angle $\alpha$ is set to be not less than $-10°$, i.e. $\alpha \leqq -10°$. In FIG. 4*b*, the angle $\alpha$ is so set as to be more than $-40°$ but less than $-10°$, i.e. $-40° < \alpha < -10°$. Meanwhile, in FIG. 4*c*, the angle $\alpha$ is so set as to be less than $-40°$, i.e. $\alpha < -40°$. When the photosensitive drum 100 and the filmy member 11 of FIGS. 4*a* to 4*c* in the inoperative state are driven by setting the peripheral speed V2 of the filmy member 11 and the peripheral speed V1 of the photosensitive drum 100 to the ratio of 3 to 1, i.e. $V2/V1=3$, the relative positions of the photosensitive drum 100 and the filmy member 11 of FIGS. 5*a* to 5*c* in the operative development state are obtained as described above. It was found that excellent development is performed in FIGS. 5*a* and 5*c*, while poor development is performed in FIG. 5*b*.

Figure 3:
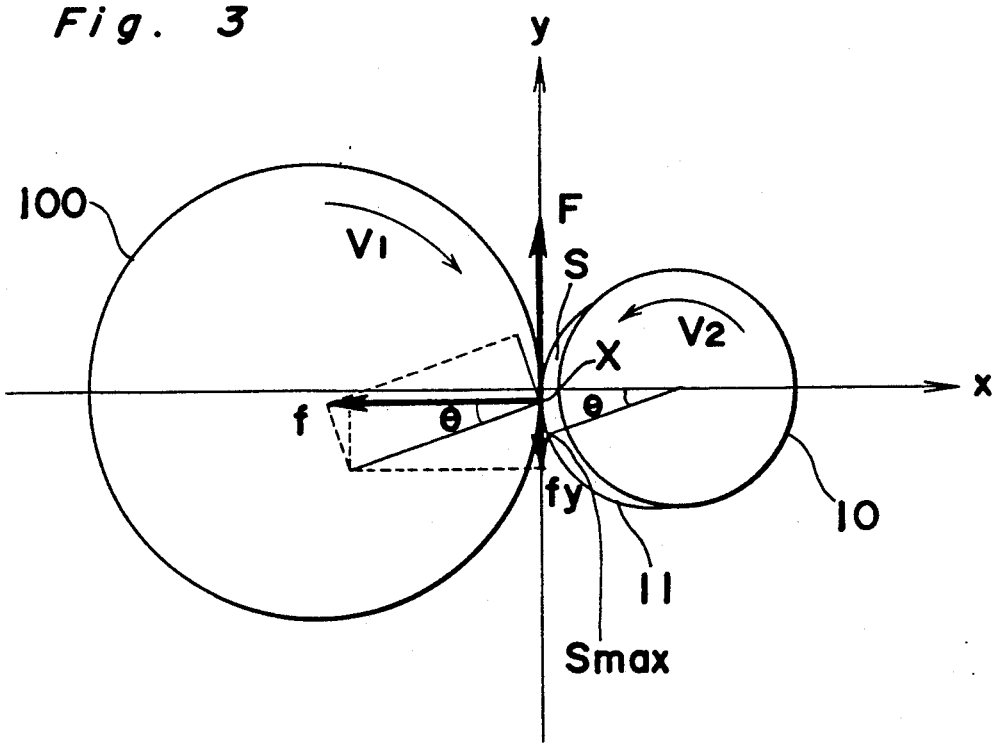
FIG. 3 is a view showing forces generated in the developing device of FIG. 1.

Conversion from the inoperative state of FIGS. 4*a* to 4*c* to the operative state of FIGS. 5*a* to 5*c* is briefly described with reference to FIG. 3. As shown in FIG. 3, forces F and f are produced between the photosensitive drum 100 and the filmy member 10 in the developing device 1. The force F is generated due to difference between a peripheral speed V1 of the photosensitive drum 100 and a peripheral speed V2 of the filmy member 11, while the force f is a force corresponding to deformation of the filmy member 11 at the time of contact between the photosensitive drum 100 an the filmy member 11. In the inoperative state of the developing device 1, an angle $\theta$ is formed between the x-axis and a line connecting the location Smax of the maximum slack of the slack portion S of the filmy member 11 and the axis of the drive roller 10 in the x-y coordinates of FIG. 3. Namely, in the inoperative state of the developing device 1, the contact portion X is disposed upstream of the location Smax of the maximum slack of the slack portion S of the filmy member 11 in the rotational direction b of the drive roller 10. At this time, the filmy member 11 is subjected to deformation corresponding to a contact state of the filmy member 11, so that the force f is produced. On the other hand, in the operative state of the developing device 1, since the peripheral speed V2 of the filmy member 11 is larger than the peripheral speed V1 of the photosensitive drum 100, the filmy member 11 is subjected to the resisting force F from the photosensitive drum 100. Therefore, based on whether or not a y-axis component fy of the force f is greater than the force F, a point of contact (contact portion X) of the filmy member 11 with the photosensitive drum 100 is determined. It is considered that in the case where operation of the developing device 1 is started in the inoperative state of the developing device 1 of FIG. 4*a*, the force F is larger than the force fy and thus, the filmy member 11 is stably brought into contact with the photosensitive drum 100 in a state where the location Smax of the maximum slack of the slack portion S of the filmy member 11 is disposed upstream of the contact portion X in the rotational direction b of the drive roller 10 as shown in FIG. 5*a*. Meanwhile, it is considered that in the case where operation of the developing device 1 is started in the inoperative state of the developing device 1 of FIG. 4*c*, the force F apparently becomes smaller than the force fy and thus, the filmy member 11 is stably brought into contact with the photosensitive drum 100 in a state where the location Smax of the maximum slack of the slack portion S of the filmy member 11 is disposed downstream of the contact portion X in the rotational direction b of the drive roller 10 as shown in FIG. 5*c*.

On the other hand, it is considered that in the case where operation of the developing device 1 is started in the inoperative state of the developing device 1 of FIG. 4*b*, the force F and the force fy become substantially identical with each other and thus, the location Smax of the maximum slack of the slack portion S of the filmy member 11 is unstably vibrated at the contact portion X as shown in FIG. 5*b* with the result that the filmy member 11 is unstably brought into contact with the photosensitive drum 100. It was found that an image developed in this state has nonuniform density particularly at its opposite end portions. Meanwhile, it may be concluded that in the case where the angle $\alpha$ is so set as to be larger than 0°, i.e. $\alpha > 0°$ in the inoperative state of the developing device 1 as shown in FIG. 1, the force F and the force fy are oriented in an identical direction and thus, the filmy member 11 is most stably brought into contact with the photosensitive drum 100.

Figure 6A:
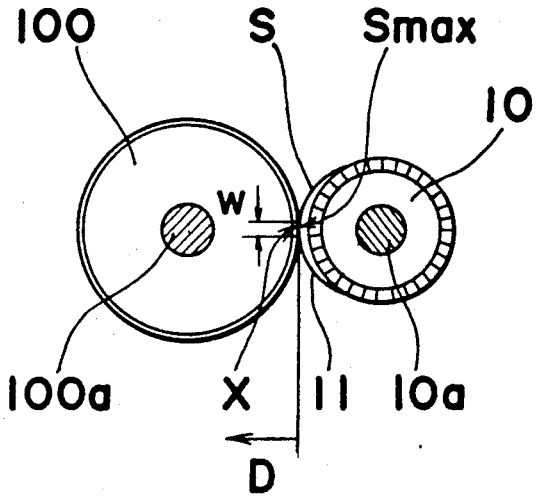
FIGS. 6*a* and 6*b* are views explanatory of width of contact between the filmy member and the photosensitive drum of FIGS. 3*a* to 3*c*.
Figure 6B:
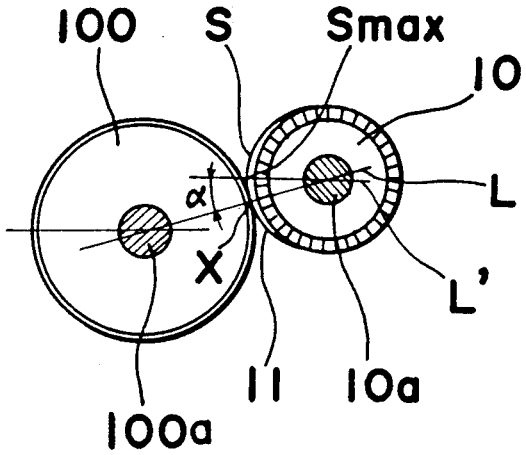

A nip (contact) width in contact between the slack portion S of the filmy member 11 and the peripheral surface of the photosensitive drum 100 is now described with reference to FIGS. 6*a* and 6*b*. It is assumed that when the location Smax of the maximum slack of the slack portion S of the filmy member 11 is disposed on the centerline connecting the shaft 10*a* of the drive roller 10 and the shaft 100*a* of the photosensitive drum 100 as shown in FIG. 6*a*, a nip width w is obtained by depressing the filmy member 11 against the photosensitive drum 100 in the horizontal direction of the arrow D. At this time, the slack portion S of the filmy member 11 is deformed so as to bulge in upward and downward directions from the contact portion X and thus, the nip width w varies greatly.

On the other hand, when the filmy member 11 is brought into contact with the photosensitive drum 100 such that the angle $\alpha$ is formed between the centerline L connecting the shaft 10*a* of the drive roller 10 and the shaft 100*a* of the photosensitive drum 100 and the line L' connecting the shaft 10*a* of the drive roller 10 and the location Smax of the maximum slack of the slack portion S of the filmy member 11, the slack portion S of the filmy member 11 is so urged as to deviate upwardly, so that deformation of the filmy member 11 becomes extremely small. In FIG. 6*b*, the contact portion X is disposed downstream of the location Smax of the maximum slack of the slack portion S of the filmy member 11 in the rotational direction b of the drive roller 10. However, also in the case where the contact portion X is disposed upstream of the location Smax of the maximum slack of the slack portion S of the filmy member 11, variation of the nip width is smaller than that of FIG. 6*a* in the same manner as in FIG. 6*b*.

Figure 7:
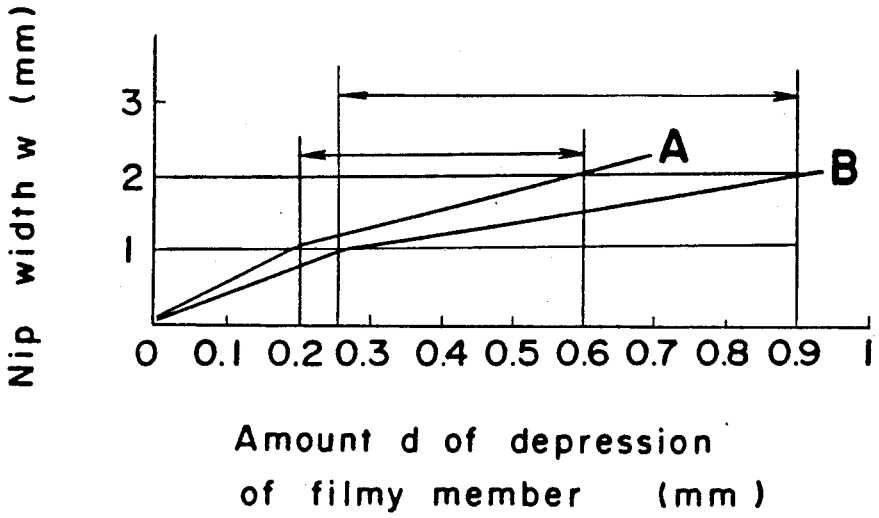
FIG. 7 is a graph showing relation between amount of depression of the filmy member against the photosensitive drum and width of contact of FIGS. 6*a* and 6*b*.

Then, a permissible range of amount d of depression of the filmy member 11 against the photosensitive drum 100 is described in the case where the nip width (contact width) w is set to 1 to 2 mm. In the state of FIG. 6*a* in which the location Smax of the maximum slack of the slack portion S of the filmy member 11 coincides with the contact portion X, the amount d of depression for bringing the filmy member 11 into contact with the photosensitive drum 100 at the nip width w has a permissible range of 0.2 to 0.6 mm as shown by the line A in FIG. 7. On the other hand, in the state of FIG. 6*b* in which the contact portion X is disposed downstream of the location Smax of the maximum slack of the slack portion S of the filmy member 11 in the rotational direction of the drive roller 10, the amount d of depression has a permissible range of 0.25 to 0.9 mm as shown by the line B in FIG. 7. Therefore, when the contact portion X between the photosensitive drum 100 and the filmy member 11 is disposed downstream of or upstream of the location Smax of the maximum slack of the slack portion S of the filmy member 11, the permissible range of the amount d of depression becomes larger than that of FIG. 6*a*, so that a greater degree of freedom can be obtained in design of the developing device 1 and thus, assembly of the developing device 1 is facilitated.

As is clear from the foregoing description, in the electrostatic latent image developing device of the present invention, the slack portion is formed on the filmy member having the peripheral length slightly larger than that of the drive roller and is softly brought into contact, through rigidity of the filmy member, with the surface of the photosensitive drum having the electrostatic latent image formed thereon so as to supply to the surface of the photosensitive drum the toner held on the surface of the filmy member such that the electrostatic latent image on the surface of the photosensitive drum is developed into the visible image. At this time, since the contact portion between the slack portion of the filmy member and the photosensitive drum is disposed upstream of or downstream of the location of the maximum slack of the slack portion of the filmy member, vibration of the filmy member is restricted and thus, the filmy member is brought into sliding contact with the photosensitive drum smoothly. Therefore, high-quality excellent development can be performed so as to obtain a uniform image free from nonuniform or faint portions.

Meanwhile, in accordance with the present invention, since the permissible range of depression of the filmy member against the photosensitive drum can be increased greatly, stable development having minimum variation of the contact width between the filmy member and the photosensitive drum can be performed and assembly of the developing device is facilitated.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A developing device confronting a rotatably provided electrostatic latent image support member and comprising;

a rotatable developing roller which is disposed so as to confront said electrostatic latent image support member;

a flexible outer sleeve which has a peripheral length larger than that of said developing roller so as to be loosely mounted around said developing roller;

an urging means which depresses said outer sleeve against said developing roller so as to form a slack of said outer sleeve at a location confronting said image support member with an angle between a line connecting a center point of said developing roller and a portion of said outer sleeve at which a maximum slack is formed and a line connecting the center point of said developing roller and the center point of said image support member when said developing roller is rotated; and means for forming a toner layer on the peripheral surface of said outer sleeve.

2. A developing device as claimed in claim 1, wherein said urging means has a guide surface of a shape corresponding to a peripheral surface of said developing roller so as to depress said outer sleeve against said developing roller at opposite end portions of said developing roller.

3. A developing device as claimed in claim 2, wherein the guide surface of said urging means has a central angle of 180° to 250° with respect to the axis of said developing roller and said urging means has an opening confronting said electrostatic latent image support member.

4. A developing device confronting a rotatably provided electrostatic latent image support member and comprising:

a rotatable roller which is disposed so as to confront said electrostatic latent image support member;

a flexible outer sleeve which has a peripheral length larger than that of said developing roller so as to be loosely mounted around said developing roller;

an urging means which depresses said outer sleeve against said developing roller so as to form a slack of said outer sleeve at a location confronting said electrostatic latent image support member such that a portion of said outer sleeve at which a maximum slack is formed is disposed at an upstream side of a position of contact between said electrostatic latent image support member and said outer sleeve in a rotational direction of said outer sleeve when said developing roller is rotated; and means for forming a toner layer on the peripheral surface of said outer sleeve.

5. A developing device as claimed in claim 4, wherein a guide surface of said urging means, said developing roller and said outer sleeve are selected to satisfy a relationship of $\mu 1 > \mu 2$ where a dynamic coefficient of friction between an external surface of said developing roller and an internal surface of said outer sleeve is $\mu 1$ and that between an external surface of said outer sleeve and the guide surface of said urging means is $\mu 2$.

6. A developing device confronting a rotatably provided electrostatic latent image support member and comprising:

a rotatable developing roller which is disposed so as to confront said electrostatic latent image support member;

a flexible outer sleeve which has a peripheral length larger than that of said developing roller so as to be loosely mounted around said developing roller;

an urging means which depresses said outer sleeve against said developing roller so as to form a slack of said outer sleeve at a location confronting said electrostatic latent image support member such that a portion of said outer sleeve at which a maximum slack is formed is disposed at a downstream side of a position of contact between said electrostatic latent image support member and said outer sleeve in a rotational direction of said outer sleeve when said developing roller is rotated; and means for forming a toner layer on the peripheral surface of said outer sleeve.

7. A developing device as claimed in claim 6, wherein a guide surface of said urging means, said developing roller and said outer sleeve are selected to satisfy a relationship of $\mu 1 > \mu 2$ where a dynamic coefficient of friction between an external surface of said developing roller and an internal surface of said outer sleeve is $\mu 1$ and that between an external surface of said outer sleeve and the guide surface of said urging means is $\mu 2$.

8. A developing device as claimed in claim 1, wherein said outer sleeve is formed by a resinous sheet.

9. A developing device as claimed in claim 1, wherein said outer sleeve is formed by a metallic thin film.

10. A developing device as claimed in claim 4, wherein said outer sleeve is formed by a resinous sheet.

11. A developing device as claimed in claim 4, wherein said outer sleeve is formed by a metallic thin film.

12. A developing device as claimed in claim 6, wherein said outer sleeve is formed by a resinous sheet.

13. A developing device as claimed in claim 6, wherein said outer sleeve is formed by a metallic thin film.

14. A developing device for developing an electrostatic latent image formed on a rotatable image support member, said developing device comprising:

a rotatable developing roller which is disposed so as to confront said electrostatic latent image support member;

a flexible outer sleeve which has a peripheral length larger than that of said developing roller so as to be loosely mounted around said developing roller;

an urging means which depresses said outer sleeve against said developing roller so as to form a slack of said outer sleeve at a location confronting said image support member such that a portion of said outer sleeve at which a maximum slack is formed is disposed at an upstream side with respect to a line defined by the center points of the developing roller and the image support member in a rotational direction of said outer sleeve; and means for forming a toner layer on the peripheral surface of said outer sleeve.

15. A developing device as claimed in claim 14, wherein said urging means includes a pad having a shape corresponding to a peripheral surface of said developing roller so as to depress said outer sleeve against said developing roller.

16. A developing device for developing an electrostatic latent image formed on a rotatable image support member, said developing device comprising:

a rotatable developing roller which is disposed so as to confront said electrostatic latent image support member;

a flexible outer sleeve which has a peripheral length larger than that of said developing roller so as to be loosely mounted around said developing roller;

an urging means which depresses said outer sleeve against said developing roller so as to form a slack of said outer sleeve at a location confronting said image support member such that a portion of said outer sleeve at which a maximum slack is formed is disposed at a downstream side with respect to a center line defined by the center points of the developing roller and the image support member in a rotational direction of said outer sleeve so as to form an angle of at least 40 degrees between a line connecting a center point of the developing roller and the portion of said outer sleeve at which the maximum slack is formed and the center line; and means for forming a toner layer on the peripheral surface of said outer sleeve.

17. A developing device as claimed in claim 16, wherein said urging means includes a pad having a shape corresponding to a peripheral surface of said developing roller so as to depress said outer sleeve against said developing roller.

18. In a developing device disposed adjacently to a rotatably arranged image support member for developing an electrostatic latent image formed on the image support member, a method comprising the steps of:

providing a developing roller opposite to said image support member;

providing a flexible outer sleeve which has a peripheral length larger than that of said developing roller so as to be loosely mounted around said developing roller;

rotating the flexible outer sleeve;

pressing said flexible outer sleeve against said developing roller so as to form a slack of said flexible outer sleeve at a location confronting said image support member with an angle between a line connecting a center point of the developing roller and a portion of said flexible sleeve at which a maximum slack is formed and a line connecting the center point of the developing roller and the center point of the image support member; and providing toner to the surface of the flexible outer sleeve, said provided toner being transported to a location confronting to the image support member to develop said electrostatic latent image.

* * * * *